US010781598B2

(12) United States Patent
Branagan et al.

(10) Patent No.: US 10,781,598 B2
(45) Date of Patent: Sep. 22, 2020

(54) COMBINATION STEP BOLT AND FALL PROTECTION ANCHORAGE ASSEMBLIES

(71) Applicant: Crown Castle USA Inc., Canonsburg, PA (US)

(72) Inventors: Matt Branagan, Canonsburg, PA (US); James Ruedlinger, Evansville, IN (US); Kerry Johnson, Glide, OR (US); Christian Beauchamp, Mountain Home, ID (US)

(73) Assignee: CROWN CASTLE USA, INC., Canonsburg, PA (US)

( * ) Notice: Subject to any disclaimer, the term of this patent is extended or adjusted under 35 U.S.C. 154(b) by 0 days.

(21) Appl. No.: 15/727,017

(22) Filed: Oct. 6, 2017

(65) Prior Publication Data

US 2018/0100318 A1 Apr. 12, 2018

Related U.S. Application Data

(60) Provisional application No. 62/404,949, filed on Oct. 6, 2016.

(51) Int. Cl.

| | |
|---|---|
| ***E04G 21/32*** | (2006.01) |
| ***A62B 35/00*** | (2006.01) |
| ***E06C 9/04*** | (2006.01) |
| ***E04H 12/00*** | (2006.01) |

(Continued)

(52) U.S. Cl.

CPC ..... *E04G 21/3276* (2013.01); *A62B 35/0068* (2013.01); *E04H 12/00* (2013.01); *E06C 7/18* (2013.01); *E06C 9/04* (2013.01); *E04C 3/30* (2013.01)

(58) Field of Classification Search

CPC ..... A62B 27/00; A62B 35/0068; E06C 9/04; Y10T 403/7111; Y10T 403/7164

USPC ..... 248/300, 301, 304, 339, 342, 206.1, 248/231.91, 499, 507; 52/127.1, 127.5, 52/127.9, 831, 712, 273

See application file for complete search history.

(56) References Cited

U.S. PATENT DOCUMENTS 907,483 A * 12/1908 Ette ..... E06C 9/04 182/189
1,322,869 A * 11/1919 Benedict ..... E06C 9/04 182/92

(Continued)

FOREIGN PATENT DOCUMENTS

GB 2100328 A 12/1982
JP S5330144 A 3/1978

(Continued)

OTHER PUBLICATIONS

Int'l Search Report and Written Opinion in counterpart PCT application PCT/US2018/048408, dated Nov. 9, 2018, 9-pgs.

*Primary Examiner* — Katherine W Mitchell
*Assistant Examiner* — Shiref M Mekhaeil
(74) *Attorney, Agent, or Firm* — Blank Rome, LLP

(57) ABSTRACT

Combination step bolt and fall protection anchorage assemblies are disclosed that may be mounted on structures such as communication towers, poles and antennas. The assemblies include a mounting plate that can be bolted to the structure, an integrated anchorage clip connected to the mounting plate having at least one safety hook hole extending therethrough, and a step bolt secured to the integrated anchorage clip.

22 Claims, 6 Drawing Sheets

(51) Int. Cl.
*E06C 7/18* (2006.01)
*E04C 3/30* (2006.01)

(56) References Cited

U.S. PATENT DOCUMENTS 2,476,863 A * 7/1949 Hawes ..... E04G 7/24 403/395
2,957,538 A * 10/1960 Pottmeyer ..... E06C 9/04 182/189
3,399,746 A * 9/1968 Wood ..... E06C 9/04 182/100
3,535,751 A * 10/1970 Batchelor ..... A01B 15/00 403/395
4,512,121 A * 4/1985 Carydias ..... E04G 21/142 52/125.2
4,867,596 A * 9/1989 Ocuin ..... F16B 7/0446 403/170
4,932,497 A * 6/1990 Raso ..... A63B 27/00 182/189
4,998,841 A * 3/1991 Wilde ..... F16B 2/065 403/104
5,143,171 A * 9/1992 Glynn ..... A62B 35/04 182/3
5,156,233 A * 10/1992 Olsen ..... E04G 17/00 182/3
5,544,717 A * 8/1996 White ..... A62B 35/0068 182/90
5,687,535 A * 11/1997 Rohlf ..... A62B 35/0068 52/713
5,699,875 A * 12/1997 Dugan ..... A62B 35/0068 182/3
5,813,486 A * 9/1998 Smith ..... A62B 35/0068 182/3
D417,328 S * 11/1999 Kwon ..... D34/35
6,068,226 A * 5/2000 Anders ..... A63B 29/024 248/231.91
6,247,553 B1 * 6/2001 Jones ..... E06C 9/04 182/92
6,378,822 B1 * 4/2002 Franks ..... E06C 1/34 182/90
6,484,982 B1 * 11/2002 Barry ..... E06C 9/04 182/90
6,625,945 B2 * 9/2003 Commins ..... E04B 1/2604 52/293.3
6,898,905 B1 * 5/2005 Kirschner ..... F16B 2/065 248/228.5
6,986,495 B2 * 1/2006 Pinkleton ..... E04F 11/00 248/507
7,793,390 B2 * 9/2010 Mills ..... F16G 11/00 24/129 R
7,866,109 B2 * 1/2011 Guillot ..... B64G 1/22 244/131
7,958,690 B2 * 6/2011 Leek ..... E02D 27/34 52/702
8,104,811 B2 * 1/2012 Seguin ..... A62B 99/00 269/3
8,387,752 B2 * 3/2013 Lagerstedt ..... A62B 1/04 182/87
9,409,055 B1 * 8/2016 Niemela ..... A63B 27/00
9,568,031 B2 * 2/2017 Grip ..... B64C 1/26
D805,658 S * 12/2017 Sailer ..... D25/69
9,856,900 B1 * 1/2018 Strange ..... F16B 33/00
D828,932 S * 9/2018 Sailer ..... D25/69
10,099,074 B2 * 10/2018 Butterfield, IV .. A62B 35/0068
10,112,078 B1 * 10/2018 Sailer ..... A63B 27/00
2002/0066247 A1 * 6/2002 Leek ..... E04B 1/2604 52/295
2004/0035637 A1 * 2/2004 Skipper ..... A01M 31/02 182/92
2006/0260261 A1 * 11/2006 Cervenko ..... E04F 13/0807 52/712
2010/0276558 A1 * 11/2010 Faust ..... F24J 2/5205 248/222.14
2011/0214367 A1 * 9/2011 Haddock ..... F24S 25/615 52/173.3
2012/0248271 A1 * 10/2012 Zeilenga ..... H02S 20/00 248/231.41
2013/0049327 A1 * 2/2013 Bowe ..... B60D 1/64 280/422
2014/0096462 A1 * 4/2014 Haddock ..... E04F 13/0821 52/173.3
2014/0299728 A1 * 10/2014 Sparks ..... F41B 5/06 248/231.91
2016/0096047 A1 * 4/2016 Sailer ..... A62B 35/0068 411/427
2016/0248367 A1 * 8/2016 Almy ..... H02S 20/23
2016/0262965 A1 * 9/2016 Goeckel ..... A61G 5/1067
2017/0080873 A1 * 3/2017 Forhan ..... B60D 1/58
2017/0361135 A1 * 12/2017 Crookston ..... A62B 35/0068
2018/0117374 A1 * 5/2018 Pascoe ..... A62B 35/0068
2018/0133526 A1 * 5/2018 Warren ..... A62B 35/0068

FOREIGN PATENT DOCUMENTS

JP S5529657 U 2/1980
JP S58143999 U 9/1983
WO 0017478 A1 3/2000

* cited by examiner

COMBINATION STEP BOLT AND FALL PROTECTION ANCHORAGE ASSEMBLIES

CROSS-REFERENCE TO RELATED APPLICATION

This application claims priority from U.S. Provisional Application No. 62/404,949 filed Oct. 6, 2016, which is incorporated herein by reference.

FIELD OF THE INVENTION

The present invention relates to combination step bolt and fall protection anchorage assemblies for use on structures, such as communication towers, poles and antennas.

BACKGROUND INFORMATION

Step bolts are typically mounted on structures that contain communication or electrical transmission equipment to be used as steps. Conventional structures that contain communication or electrical transmission equipment are constructed to have clips welded thereon for engaging step bolts along their heights. Step bolts are typically mounted on such structures in holes, e.g., by installing a threaded step bolt directly into a hole in a welded clip and securing it with two nuts, one on each side of the clip.

SUMMARY OF THE INVENTION

The present invention provides combination step bolt and fall protection anchorage assemblies that may be mounted on structures such as communication towers, poles and antennas. The assemblies include a mounting plate that can be bolted to the structure, an integrated anchorage clip connected to the mounting plate having at least one safety hook hole extending therethrough, and a step bolt secured to the integrated anchorage clip.

An aspect of the present invention provides a combination step bolt and fall protection anchorage assembly for mounting on structures. The assembly comprises a mounting plate, an integrated anchorage clip secured to the mounting plate comprising at least one safety hook hole extending therethrough, and a step bolt secured to the integrated anchorage clip and extending away from the mounting plate in a direction substantially perpendicular to a plane defined by the mounting plate.

Another aspect of the present invention provides a structure comprising multiple combination step bolt and fall protection anchorage assembles mounted thereon. Each assembly comprises a mounting plate, an integrated anchorage clip secured to the mounting plate comprising at least one safety hook hole extending therethrough, and a step bolt secured to the integrated anchorage clip and extending away from the mounting plate in a direction substantially perpendicular to a plane defined by the mounting plate.

These and other aspects of the present invention will be more apparent from the following description.

DETAILED DESCRIPTION

The present invention provides combination step bolt and fall protection anchorage assemblies for structures that contain communication or electrical transmission equipment. As used herein, the term "structure" may refer to cellular towers, communication towers, monopoles, utility poles, lattice structures, antennas, or any vertical structure. The structure may be of any known design and may typically be made of metal, wood, concrete, composites, or the like.

Figure 1:
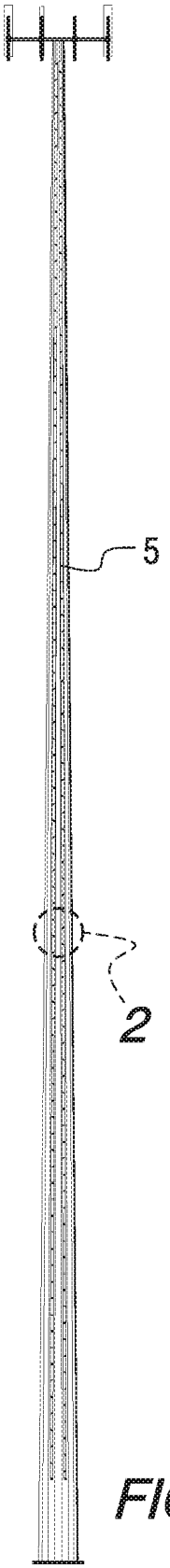
FIG. 1 is a profile or side view of a support structure in the form of a monopole communication tower including combination step bolt and fall protection anchorage assemblies in accordance with an embodiment of the present invention.
Figure 2:
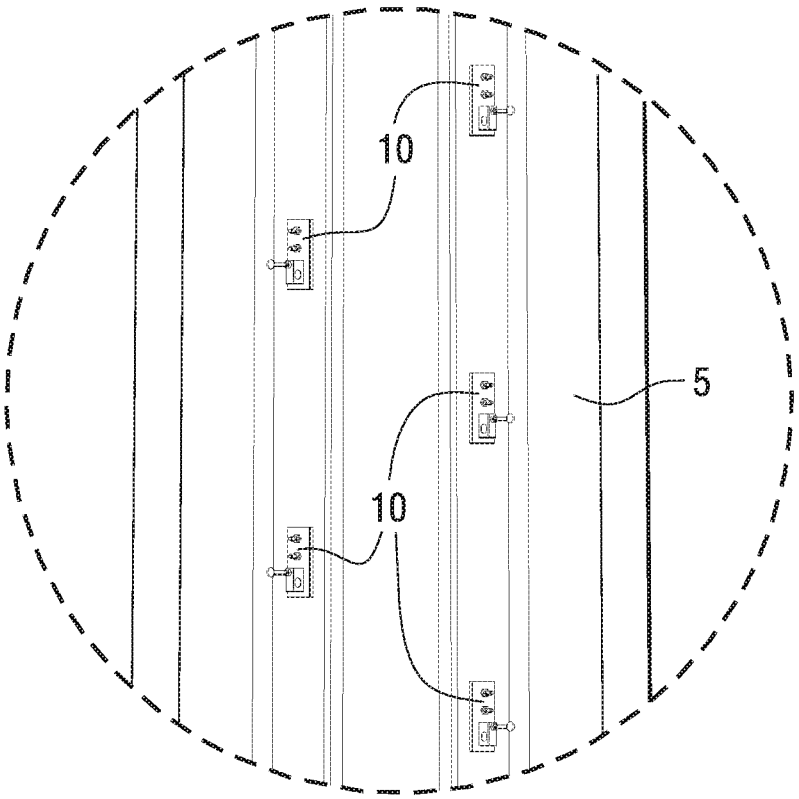
FIG. 2 is a magnified view of a portion of the support structure shown in FIG. 1.
Figure 3:
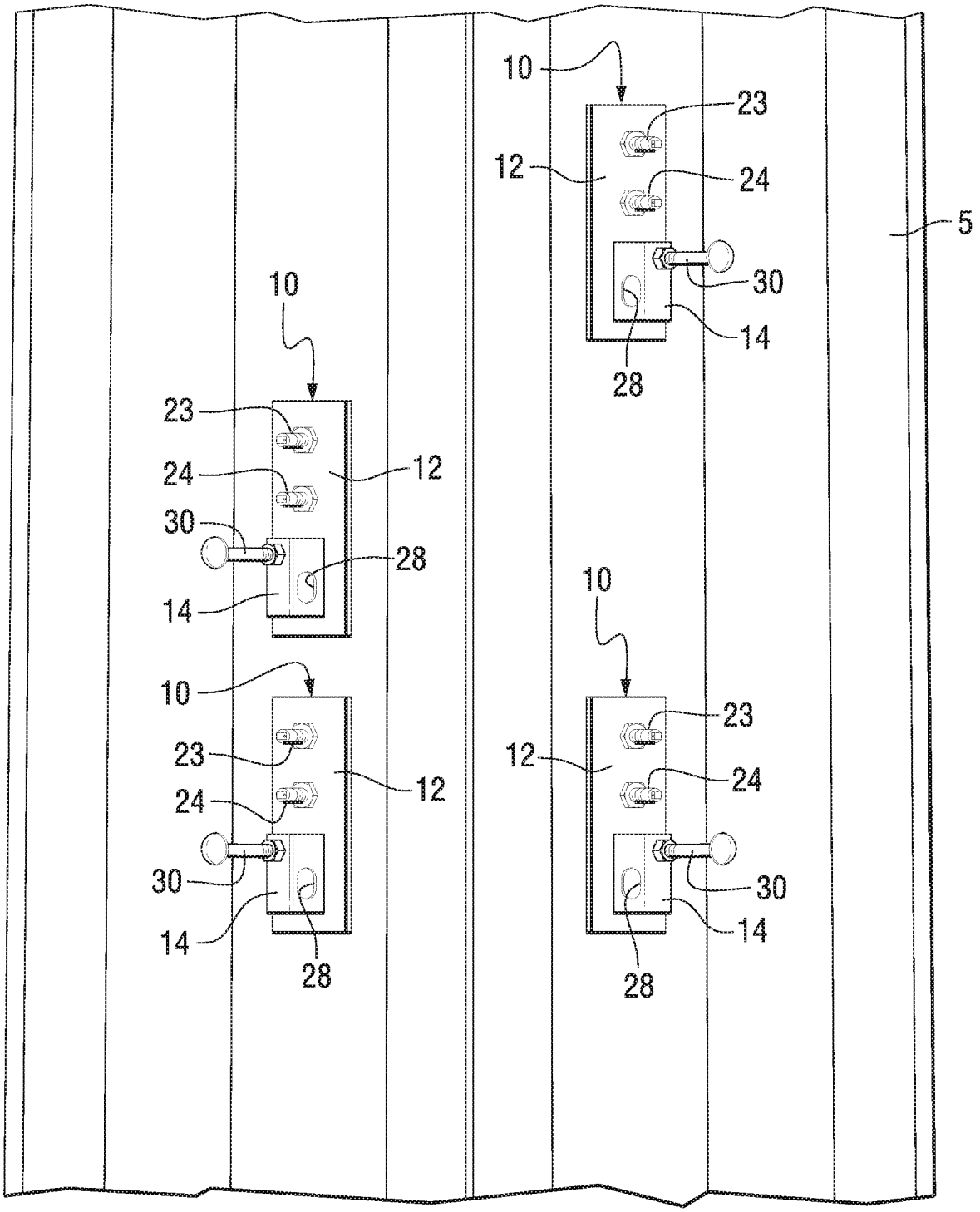
FIG. 3 is a side view of a portion of a support structure including multiple combination step bolt and fall protection anchorage assemblies in accordance with an embodiment of the present invention.

FIG. 1 illustrates a support structure 5 in the form of a monopole communication tower upon which combination step bolt and fall protection anchorage assemblies 10 may be installed in accordance with an embodiment of the present invention. The assemblies 10 can be used for new structure construction or to retrofit existing structures. FIG. 2 is a magnified portion of the support structure 5 of FIG. 1, illustrating multiple combination step bolt and fall protection anchorage assemblies 10 installed thereon. FIG. 3 is a further magnified view showing multiple assemblies 10 installed on the support structure 5. The series of combination step bolt and fall protection anchorage assemblies 10 may be mounted to the structure 5 to provide a means for climbing the structure 5. The combination step bolt and fall protection anchorage assemblies 10 near the technician may also serve as fall protection anchorage for the safety hook of the technician's climbing lanyard(s) for maintaining complete tie-off through use of the fall protection anchorages alone, as a secondary backup to the primary fall protection system, or as an alternative fall protection anchorage to facilitate working at locations away from the primary fall protection system. The combination step bolt and fall protection anchorage assemblies 10 provide for easily installable fall protection devices at desired locations. The assemblies 10 may be spaced vertically above each other any suitable distance, for example, up to 48 inches, or from 6 to 42 inches, or from 12 to 40 inches.

Figure 4:
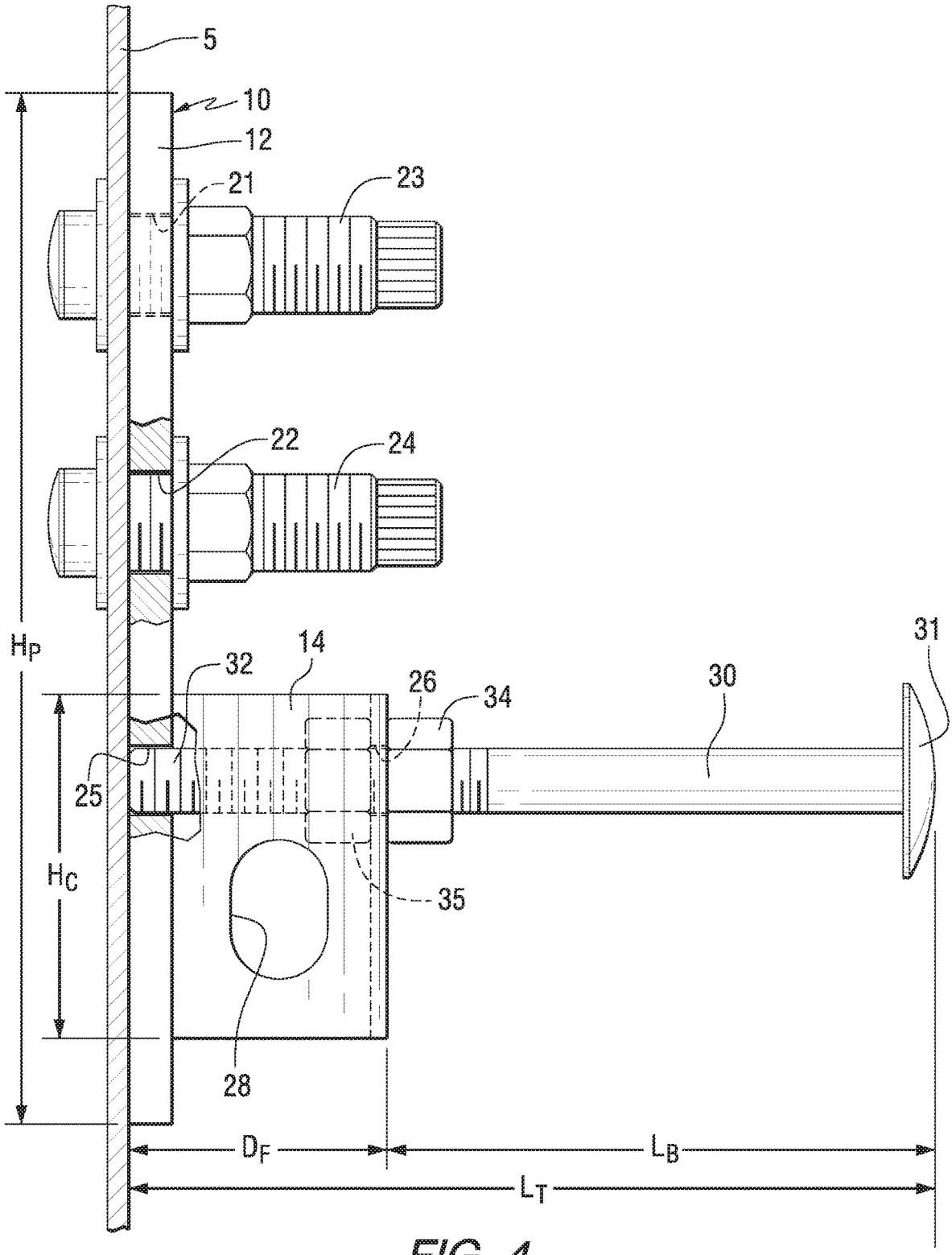
FIG. 4 is a side view of a combination step bolt and fall protection anchorage assembly secured to a support structure in accordance with an embodiment of the present invention.
Figure 5:
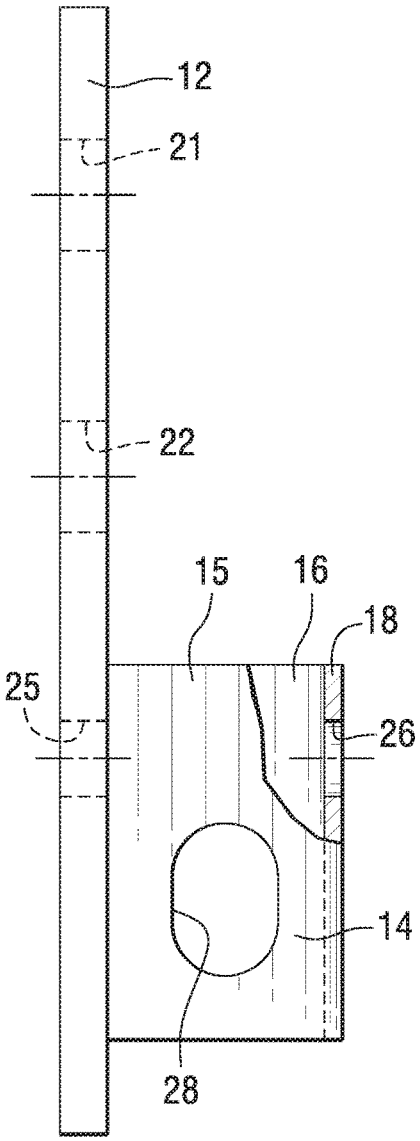
FIG. 5 is a side view of a mounting plate and integrated anchorage clip of a combination step bolt and fall protection anchorage assembly in accordance with an embodiment of the present invention.
Figure 6:
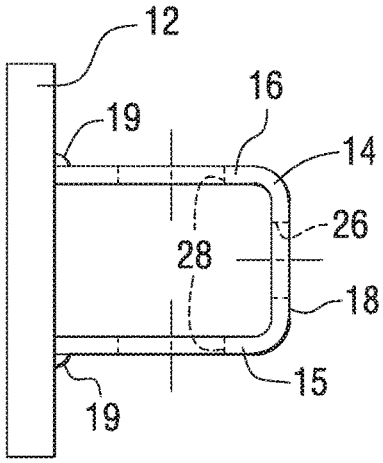
FIG. 6 is a top view of the mounting plate and integrated anchorage clip of FIG. 5.
Figure 7:
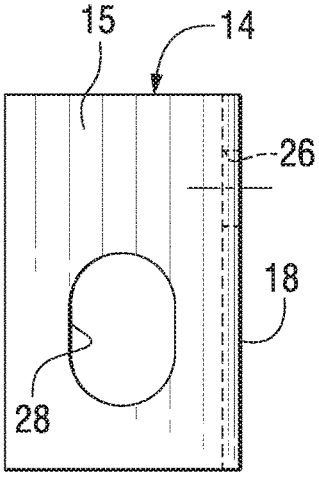
FIG. 7 is a side view of the integrated anchorage clip of FIG. 5.
Figure 8:
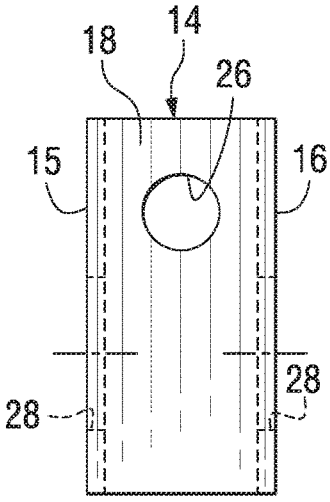
FIG. 8 is a front view of the integrated anchorage clip of FIG. 5.

FIGS. 4-8 and 10 illustrate details of a combination step bolt and fall protection anchorage assembly 10 in accordance with an embodiment of the present invention. The assembly 10 includes a mounting plate 12 having an integrated anchorage clip 14 mounted thereon. The integrated anchorage clip 14 includes a first side panel 15, a second side panel 16, and a face plate 18. In the embodiment shown, the first and second side panels 15 and 16, and the face plate 18, form a channel having a generally U-shaped cross section. The integrated anchorage clip 14 may be secured to the mounting plate 12 by any suitable means, for example, by welds 19 as shown in FIG. 6. However, any other suitable type of attachment may be used, e.g., with mechanical fasteners, a slot connection or the like. In certain embodiments, the integrated anchorage clip 14 and the mounting plate 12 may be integrally formed.

As shown in FIG. 4, the mounting plate 12 has a height $H_P$, and the integrated anchorage clip 14 has a height $H_C$. The mounting plate height $H_P$ may typically range from 6 to 24 inches, for example, from 8 to 18 inches, or from 10 to 12 inches. The integrated anchorage clip height $H_C$ may typically range from 2 to 8 inches, for example, from 2 to 4 inches. The thickness of the mounting plate 12 may typically range from 0.25 to 1.25 inches, for example, from 0.375 to 1 inch, or about 0.75 inch. The thickness of the integrated anchorage clip 14 may typically range from 0.125 to 1.25 inches, for example, from 0.125 to 0.375 inch, or about 0.1875 inch.

An upper hole 21 is provided through the mounting plate 12, and a lower hole 22 is provided through the mounting plate 12. An upper fastener mounting bolt 23 is provided through the upper hole 21 and a lower fastener bolt 24 is provided through the lower hole 22. The upper and lower fastener bolts 23 and 24 may be provided in the form of conventional blind bolts in the embodiment shown in FIG. 4. However, it is to be understood that any other suitable type of bolt or mechanical fastener may be used. Furthermore, any other suitable number of fastener bolts may be used, including a single fastener, or three or more fasteners. Although the mounting plate 12 may alternatively be welded to the support structure 5 without the use of mechanical fasteners, the use of mechanical fasteners provides advantages of less risk from fire due to welding, less damage to protective coatings of the structures such as galvanization, and increased efficiently of installation and inspection.

As shown in FIGS. 4 and 5, a step bolt hole 25 is provided through the mounting plate 12. As more fully described below, the step bolt hole 25 may be unthreaded and receives the threaded end of a step bolt. As shown in FIGS. 4-8, the integrated anchorage clip 14 includes an unthreaded step bolt hole 26 through the face plate 18. Alternatively, the step bolt hole 26 in the front face 18 of the U-shaped integrated anchorage clip 14 may be threaded to engage the threaded portion of the step bolt 30 or the mounting plate 12 may be threaded to serve as the step bolt 30 attachment point.

Safety hook holes 28 are provided through the side panels 15 and 16 for receiving a safety hook, as more fully described below. In the embodiment shown, the safety hook holes 28 are vertically elongated. However, any other suitable hole shape may be used.

Figure 10:
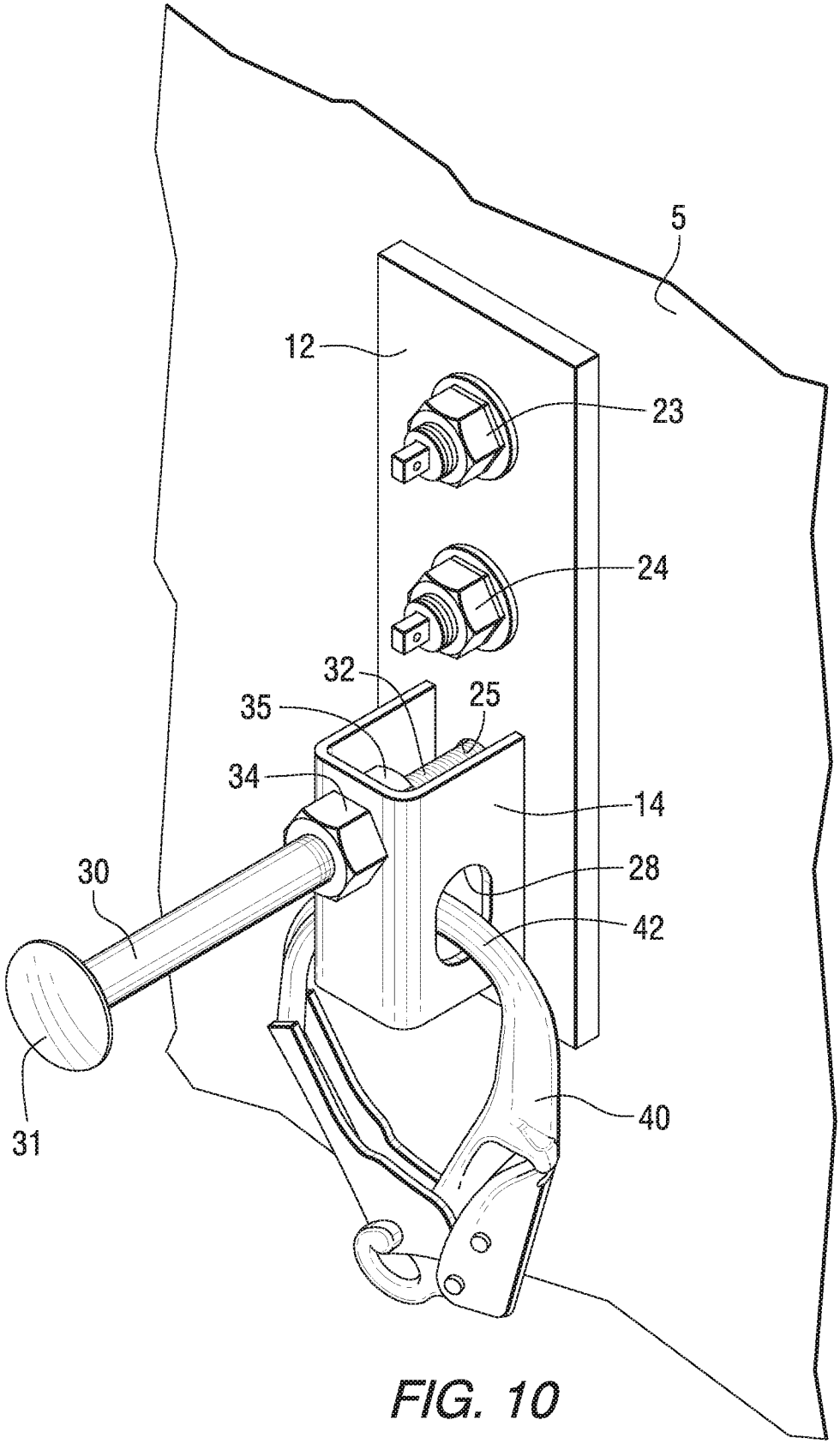
FIG. 10 is an isometric view of a combined step bolt and fall protection anchor assembly having a safety hook mounted thereon in accordance with an embodiment of the present invention.

As shown in FIGS. 4 and 10, the assembly 10 includes a step bolt 30 having a head 31 at one end and an opposite threaded end 32. The step bolt 30 passes through the step bolt hole 26 of the face plate 18, and also extends into the step bolt hole 25 of the mounting plate 12. An exterior threaded nut 34 is threaded onto the step bolt 30 against the exterior surface of the face plate 18. An interior threaded nut 35 is threaded on the step bolt 30 against an interior face of the face plate 18.

In the embodiment shown, the safety hook holes 28 extend through the first and second side walls 15 and 16 of the integrated anchorage clip 14 at a height that is vertically below the height of the step bolt hole 26 extending through the face plate 18. This arrangement provides safety hook holes 28 below the step bolt 30 of each assembly 10.

As shown in FIG. 4, the face plate 18 of the integrated anchorage clip 14 extends a distance $D_F$ from the rear surface of the mounting plate 12. The extended distance $D_F$ may typically range from 1 to 5 inches, for example, from 2 to 4 inches. The step bolt 30 has an exposed length $L_B$ measured from the exterior surface of the face plate 18 to the end of the head 31. The step bolt 30 also has a total length $L_T$ measured from the exterior surface of the support structure 5 to the end of the head 31. The exposed length $L_B$ may typically range from 4 to 9 inches, for example, from 5 to 8 inches. The integrated anchorage clip 14 has a depth sufficient to accommodate the threaded portion of the step bolt 30 and the interior threaded nut 35. In the embodiment shown, the step bolt 30 is threadingly engaged with interior and exterior nuts 35 and 34; however, any other suitable type of arrangement may be used, e.g., clips, pins, adhesive or the like.

The extended distance $D_F$ of the face plate 18 provides several advantages over conventional step bolt designs. For example, the extended distance $D_F$ of the face plate 18 provides an offset from the external surface of the support structure 5 that extends the foot-engaging and/or hand-engaging portion of the step bolt 30 horizontally beyond the upper and lower fastener bolts 23 and 24. In this manner, the area above the step bolt 30 is not obstructed by the upper and lower fastener bolts 23 and 24, thereby facilitating placement of a worker's foot or hand on the step bolt without unwanted contact with the fastener bolts.

The components of the combination step bolt and fall protection anchorage assembly 10 of the present invention may be made from any suitable materials known to those skilled in the art. For example, the anchor plate 12 and integrated anchorage clip 14 may be made from steel, aluminum, composite polymer material or the like.

Figure 9:
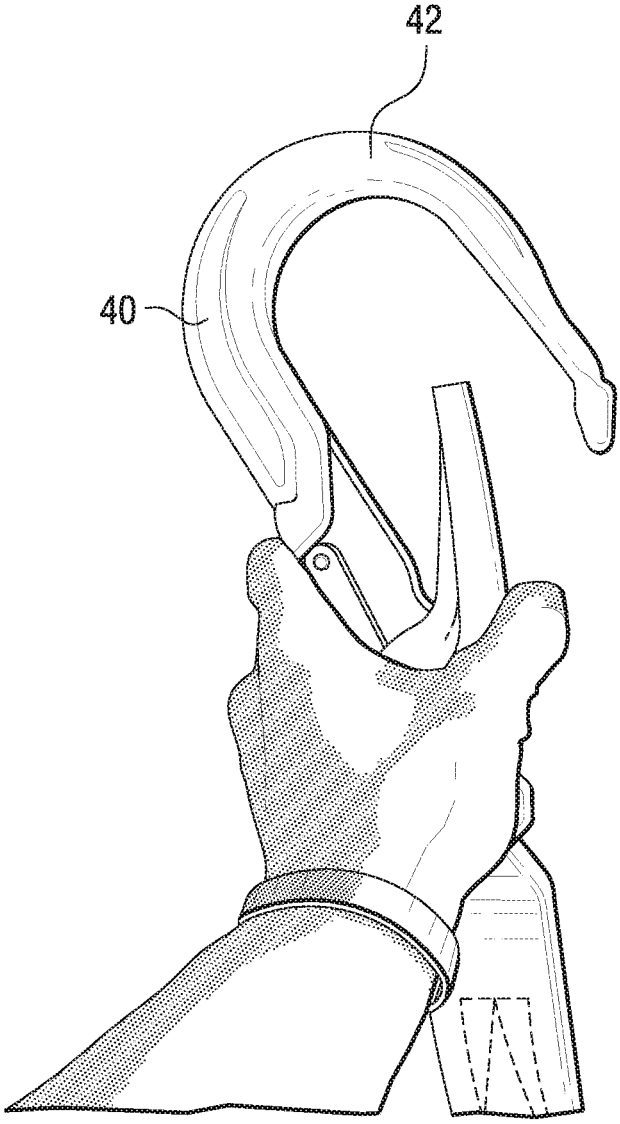
FIG. 9 illustrates a safety hook that may be used with a combined step bolt and fall protection anchor assembly in accordance with an embodiment of the present invention.

FIGS. 9 and 10 illustrate a safety hook 40 that may be used with the assembly 10 in accordance with an embodiment of the present invention. As shown in FIG. 10, an engagement portion 42 of the safety hook 40 may be installed through the hook holes 28 of the first and second side panels 15 and 16. The U-shaped integrated anchorage clip 14 may comprise a single or multiple fall protection anchorage holes 28 for receiving the climbing lanyard safety hook 40 as a fall protection anchorage point. The available mounting options made possible by the combination step bolt and fall protection anchorage assembly 10 allows the assembly to be bolted directly to the structure in lieu of welding. As understood by those skilled in the art, the safety hook 40 is secured to conventional safety strap and harness equipment (not shown) to provide increased safety for workers servicing the support structure 5.

The side anchorage holes 28 thus serve as a fall protection anchorage for attaching the climbing lanyard safety hook 40. The integrated anchorage clip 14 may be symmetrical around the step bolt hole in the front face, which provides a technician easy access to the side anchorage holes 28 regardless of which side of the combination step bolt and fall protection anchorage assembly 10 they approach. This arrangement consistently provides the technician with access to the side anchorage holes 28 without having to reach under and/or work around the step bolt 30. The safety hook may engage both legs of the U-shaped step bolt clip 14 to provide two points of support and distribute the weight of the technician across the combination step bolt and fall protection anchorage, thus ensuring that the assembly 10 can support the technician. The vertical distance between the step bolt hole 26 on the front face 18 and the side anchorage holes 28 may also allow the safety hook 40 to be easily inserted into the combination step bolt and fall protection anchorage assembly 10 without interference from the step bolt 30.

Thus, in accordance with the present invention, the integrated anchorage clip 14 secures the step bolt 30 at one location and provides an integrated fall protection anchorage point for the safety lanyard hook 40 at another point. The integrated anchorage clip 14 may also provide a more substantial engagement between the step bolt 30 and the mounting plate 12. The two legs of the integrated anchorage clip 14 provide at least two points of engagement with the plate 12.

An advantage of the present invention is that the integrated side fall protection anchorage holes 28 may be provided below the step bolt 30 to provide unobstructed access to the step bolt and fall protection anchorage. However, the side fall protection anchorage holes can be placed in other locations relative to any bolt. This arrangement provides for convenient access to fall protection anchorage points when the technician is climbing. In accordance with an embodiment of the present invention, when the technician is reaching for a grip/handhold on the step bolt above the technician, the side anchorage holes being located under the step bolt allows the technician to easily insert the safety hook into the combination step bolt and fall protection anchorage before grabbing the step bolt.

As used herein, "including," "containing" and like terms are understood in the context of this application to be synonymous with "comprising" and are therefore open-ended and do not exclude the presence of additional undescribed or unrecited elements, materials, phases or method steps. As used herein, "consisting of" is understood in the context of this application to exclude the presence of any unspecified element, material, phase or method step. As used herein, "consisting essentially of" is understood in the context of this application to include the specified elements, materials, phases, or method steps, where applicable, and to also include any unspecified elements, materials, phases, or method steps that do not materially affect the basic or novel characteristics of the invention.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application and the appended claims, the articles "a," "an," and "the" include plural referents unless expressly and unequivocally limited to one referent.

Whereas particular embodiments of this invention have been described above for purposes of illustration, it will be evident to those skilled in the art that numerous variations of the details of the present invention may be made without departing from the invention as defined in the appended claims.

What is claimed is:

1. A combination step bolt and fall protection anchorage assembly for mounting on a surface of a structure, the assembly comprising:

a mounting plate defining a plane and having a first bolt hole therein, the mounting plate configured to mount on the surface of the structure;

an integrated anchorage clip affixed directly to the mounting plate and having a face plate, the face plate of the integrated anchorage clip having a second bolt hole therethrough that is at an extended distance from the first bolt hole of the mounting plate, the integrated anchorage clip comprising at least one safety hook hole extending therethrough; and a step bolt having a first end, an intermediate portion, and a second end, the intermediate portion disposed through the second bolt hole and being supported at face plate of the integrated anchorage clip, the first end disposed in the first bolt hole and being supported at the mounting plate, an exposed length of the second end of the step bolt extending away from the integrated anchorage clip in a direction substantially perpendicular to the plane defined by the mounting plate.

2. The assembly of claim 1, wherein the integrated anchorage clip comprises first and second side panels affixed directly to the mounting plate, the face plate extending between the first and second side panels, the face plate having the second bolt hole therethrough and being disposed the extended distance from the mounting plate.

3. The assembly of claim 2, wherein each of the first and second side panels has one of the safety hook holes extending therethrough.

4. The assembly of claim 3, wherein the safety hook holes are located at a first vertical height, and the second step bolt hole and the step bolt are located at a second vertical height above the first vertical height.

5. The assembly of claim 2, further comprising:

an exterior threaded nut threaded on the intermediate portion of the step bolt and contacting an exterior surface of the face plate, and an interior threaded nut threaded on the intermediate portion of the step bolt and contacting an interior surface of the face plate.

6. The assembly of claim 5, wherein the first end of the step bolt comprises a threaded end of the step bolt disposed into the first bolt hole extending at least partially through the mounting plate.

7. The assembly of claim 1, wherein the integrated anchorage clip has a height HC of from 2 to 8 inches, and has the extended distance DF measured from an exterior surface of the face plate to a rear surface of the mounting plate of from 1 to 5 inches.

8. The assembly of claim 7, wherein the step bolt has the exposed length LB measured from the exterior surface of the face plate to the second end of the step bolt of from 4 to 9 inches.

9. The assembly of claim 1, wherein the integrated anchorage clip is affixed directly to the mounting plate by at least one weld.

10. The assembly of claim 1, wherein the mounting plate comprises at least one mounting hole extending therethrough structured and arranged to receive a fastener bolt for securing the assembly to the structure.

11. The assembly of claim 1, wherein the at least one safety hook hole is elongated in a vertical direction.

12. The assembly of claim 1, wherein the exposed length of the second end of the step bolt extending away from the integrated anchorage clip on the mounting plate is configured as a step for foot or hand placement.

13. A structure comprising multiple combination step bolt and fall protection anchorage assemblies mounted thereon, each assembly comprising:

a mounting plate defining a plane and having a first bolt hole therein, the mounting plate configured to mount on a surface of the structure;

an integrated anchorage clip affixed directly to the mounting plate and having a face plate, the face plate having a second bolt hole therethrough that is at an extended distance from the first bolt hole of the mounting plate, the integrated anchorage clip comprising at least one safety hook hole extending therethrough; and a step bolt having a first end, an intermediate portion, and a second end, the intermediate portion disposed through the second bolt hole and being supported at the face plate of the integrated anchorage clip, the first end disposed in the first bolt hole and being supported at the mounting plate, an exposed length of the second end of the step bolt extending away from the integrated anchorage clip in a direction substantially perpendicular to the plane defined by the mounting plate.

14. The structure of claim 13, further comprising at least one fastener bolt extending through the mounting plate of each assembly into the structure.

15. The structure of claim 14, wherein each of the assemblies comprises two of the fastener bolts.

16. The structure of claim 13, wherein the assemblies are vertically spaced from each other a distance from 6 to 42 inches.

17. The structure of claim 13, wherein the structure is a communication tower, pole or antenna.

18. The structure of claim 13, wherein the integrated anchorage clip comprises first and second side panels affixed directly the mounting plate, the face plate extending between the first and second side panels, the face plate having the second bolt hole therethrough and being disposed the extended distance from the mounting plate.

19. The structure of claim 18, wherein each of the first and second side panels has one of the safety hook holes extending therethrough.

20. The structure of claim 19, wherein the safety hook holes are located at a first vertical height, and the second step bolt hole and the step bolt are located at a second vertical height above the first vertical height.

21. The structure of claim 18, further comprising:

an exterior threaded nut threaded on the intermediate portion of the step bolt and contacting an exterior surface of the face plate, and an interior threaded nut threaded on the intermediate portion of the step bolt and contacting an interior surface of the face plate.

22. The structure of claim 21, wherein the first end of the step bolt comprises a threaded end of the step bolt disposed into the first bolt hole extending at least partially through the mounting plate.

* * * * *